US010734174B2

(12) United States Patent
Liu

(10) Patent No.: US 10,734,174 B2
(45) Date of Patent: Aug. 4, 2020

(54) SILENT KEYBOARD

(71) Applicant: Dongguan Weiji Electronic Technology Co., Ltd., Dong Guan, Guangdong Province (CN)

(72) Inventor: Feng Liu, Rongxian County (CN)

(73) Assignee: DONGGUAN WEIJI ELECTRONIC TECHNOLOGY CO., LTD., Dong Guan, Guangdong Province (CN)

( * ) Notice: Subject to any disclaimer, the term of this patent is extended or adjusted under 35 U.S.C. 154(b) by 0 days.

(21) Appl. No.: 16/385,488

(22) Filed: Apr. 16, 2019

(65) Prior Publication Data

US 2019/0378668 A1 Dec. 12, 2019

(30) Foreign Application Priority Data

Jun. 11, 2018 (CN) ..... 2018 2 0904501 U

(51) Int. Cl.
*H01H 13/7065* (2006.01)
*H01H 13/86* (2006.01)

(52) U.S. Cl.
CPC ..... *H01H 13/7065* (2013.01); *H01H 13/86* (2013.01); *H01H 2209/004* (2013.01)

(58) Field of Classification Search
CPC ..... H01H 13/7065; H01H 13/86; H01H 2209/004; H01H 2221/062; H01H 2009/0278; H01H 13/84; H01H 13/85
USPC ..... 200/5 A, 341, 344, 345
See application file for complete search history.

(56) References Cited

U.S. PATENT DOCUMENTS 6,242,705 B1 * 6/2001 Huang ..... H01H 13/705 200/341
6,610,948 B1 * 8/2003 Tsau ..... H01H 13/705 200/345
7,462,796 B1 * 12/2008 Chai ..... H01H 13/705 200/341

(Continued)

FOREIGN PATENT DOCUMENTS

CN 201063301 Y 5/2008
TW 510559 U 11/2002

OTHER PUBLICATIONS

Taiwanese Office Action and Search Report for Taiwanese Application No. 108113100, dated Sep. 19, 2019, with English translation of the Search Report.

*Primary Examiner* — Edwin A. Leon
*Assistant Examiner* — Lheiren Mae A Caroc
(74) *Attorney, Agent, or Firm* — Birch, Stewart, Kolasch & Birch, LLP

(57) ABSTRACT

The disclosure generally relates to a keyboard and, more particularly, to a silent keyboard. A first pressing portion is formed of two strengthening strip elements intersected with each other, and utilized to enhance the rigidity and stability of four guiding pillars. Two grooves are formed on the inner walls of a first frame. Two hooks positioned in opposing sides and two silencing strip elements positioned in opposing sides are formed on the underside of a first key cap and extend outward from the first key cap. The two hooks respectively engage with the two grooves, while each hook is arranged to operably slide along a corresponding groove. The two silencing strip elements engage with the inner walls of the first frame, so that a first key structure can slide steadily within the first frame and does not tilt while sliding.

11 Claims, 7 Drawing Sheets

(56) References Cited

U.S. PATENT DOCUMENTS 7,687,732 B1 * 3/2010 Tabata ..... H01H 13/705
200/341

* cited by examiner

SILENT KEYBOARD

CROSS-REFERENCE TO RELATED APPLICATIONS

This application claims the benefit of priority to Patent Application No. 201820904501.6, filed in China on Jun. 11, 2018; the entirety of which is incorporated herein by reference for all purposes.

BACKGROUND

The disclosure generally relates to a keyboard and, more particularly, to a silent keyboard.

Generally, a conventional keyboard structure includes a base frame and multiple key structures. The base frame includes multiple receiving chambers utilized for placing multiple key structures. Each receiving chamber is provided with a frame formed on the inner walls of the receiving chamber, and the frame is utilized for placing a key structure. Each key structure includes a key cap, a pressing portion having a column shape and positioned on the underside of the key cap, and a trigger portion positioned on the underside of the pressing portion. Four guiding pillars are formed on the underside of the key cap and extend outward from the key cap. The above conventional keyboard structure can be manipulated normally, but during the manipulation of the key structure, the key structure easily wobbles because there is a consideration gap between the guiding pillars and the inner walls of the frame. Such situation increases the possibility that the key structure collides with the frame, and thus adversely affects the smoothness of manipulating the key structure and results in a greater noise during manipulation of the key structure.

SUMMARY

In view of the foregoing, it may be appreciated that a substantial need exists for a silent keyboard that can be manipulated more smoothly while reducing the resulting noise during manipulation of the key structure.

An example embodiment of a silent keyboard is disclosed, comprising: a base frame comprising multiple first receiving chambers; and multiple first key structures; wherein each first receiving chamber of the multiple first receiving chambers is provided with a first frame formed on inner walls of the first receiving chamber and utilized for placing one of the multiple first key structures, while two grooves are formed on inner walls of the first frame; wherein each first key structure of the multiple first key structures comprises: a first key cap; four guiding pillars formed on underside of the first key cap and extending outward from the first key cap; a first pressing portion positioned on the underside of the first key cap; and a trigger portion positioned on underside of the first pressing portion; wherein the first pressing portion is formed of two strengthening strip elements intersected with each other; two hooks positioned in opposing sides are formed on the underside of the first key cap and extend outward from the first key cap; two silencing strip elements positioned in opposing sides are formed on the underside of the first key cap and extend outward from the first key cap; the two silencing strip elements engage with the inner walls of the first frame, while the two hooks respectively engage with the two grooves of the first frame; and each of the two hooks of the first key cap is arranged to operably slide along a corresponding groove of the first frame.

Both the foregoing general description and the following detailed description are examples and explanatory only, and are not restrictive of the invention as claimed.

BRIEF DESCRIPTION OF THE DRAWINGS

In the following, the invention is further illustrated by way of example, taking reference to the accompanying drawings.

DETAILED DESCRIPTION

Reference is made in detail to embodiments of the invention, which are illustrated in the accompanying drawings. The same reference numbers may be used throughout the drawings to refer to the same or like parts, components, or operations.

Figure 1:
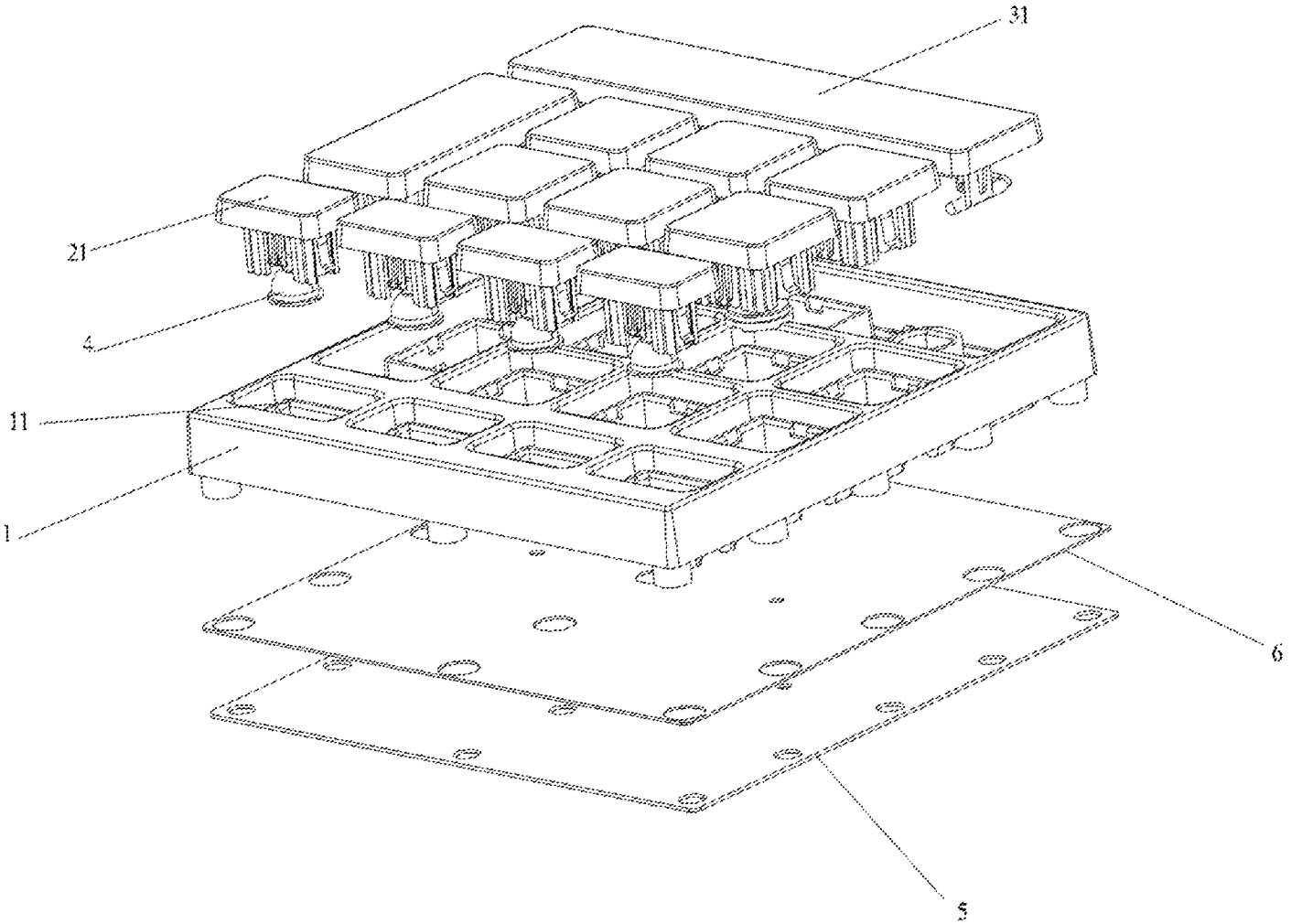
FIG. 1 shows a schematic decomposed diagram of a keyboard according to one embodiment of the present disclosure.
Figure 2:
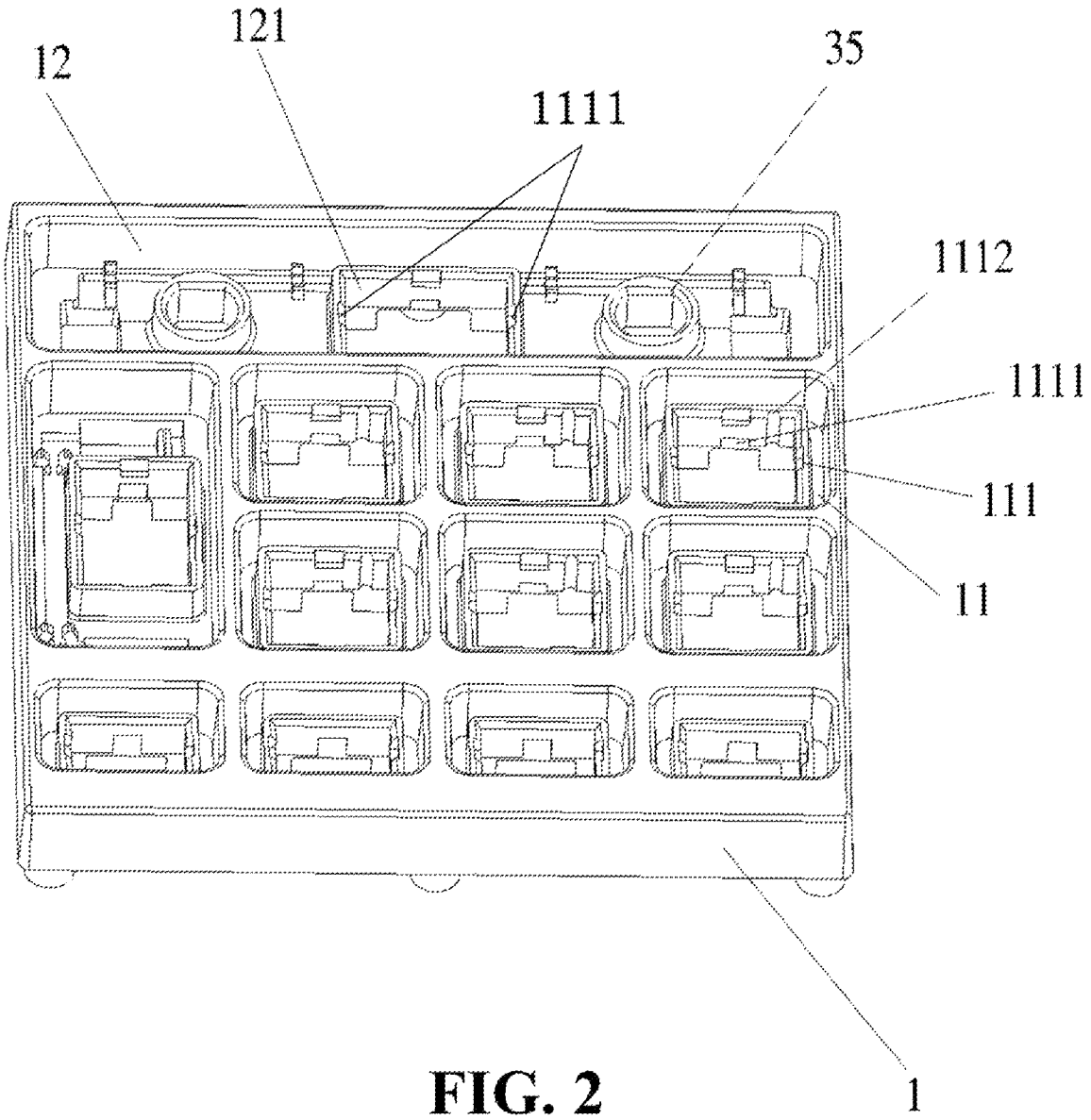
FIG. 2 shows a schematic structural diagram of a base frame according to one embodiment of the present disclosure.
Figure 3:
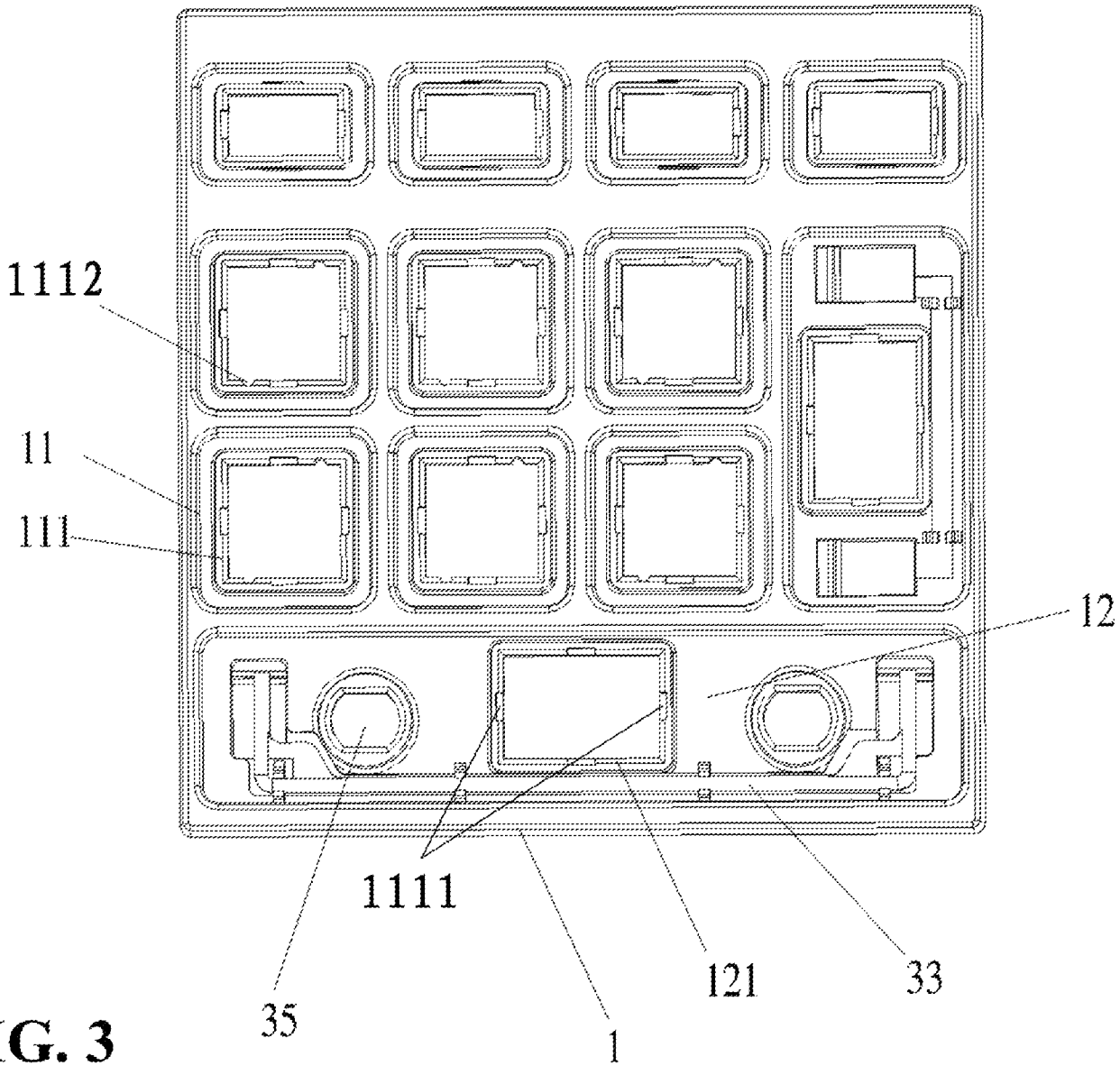
FIG. 3 shows a schematic top view diagram of a base frame according to one embodiment of the present disclosure.
Figure 4:
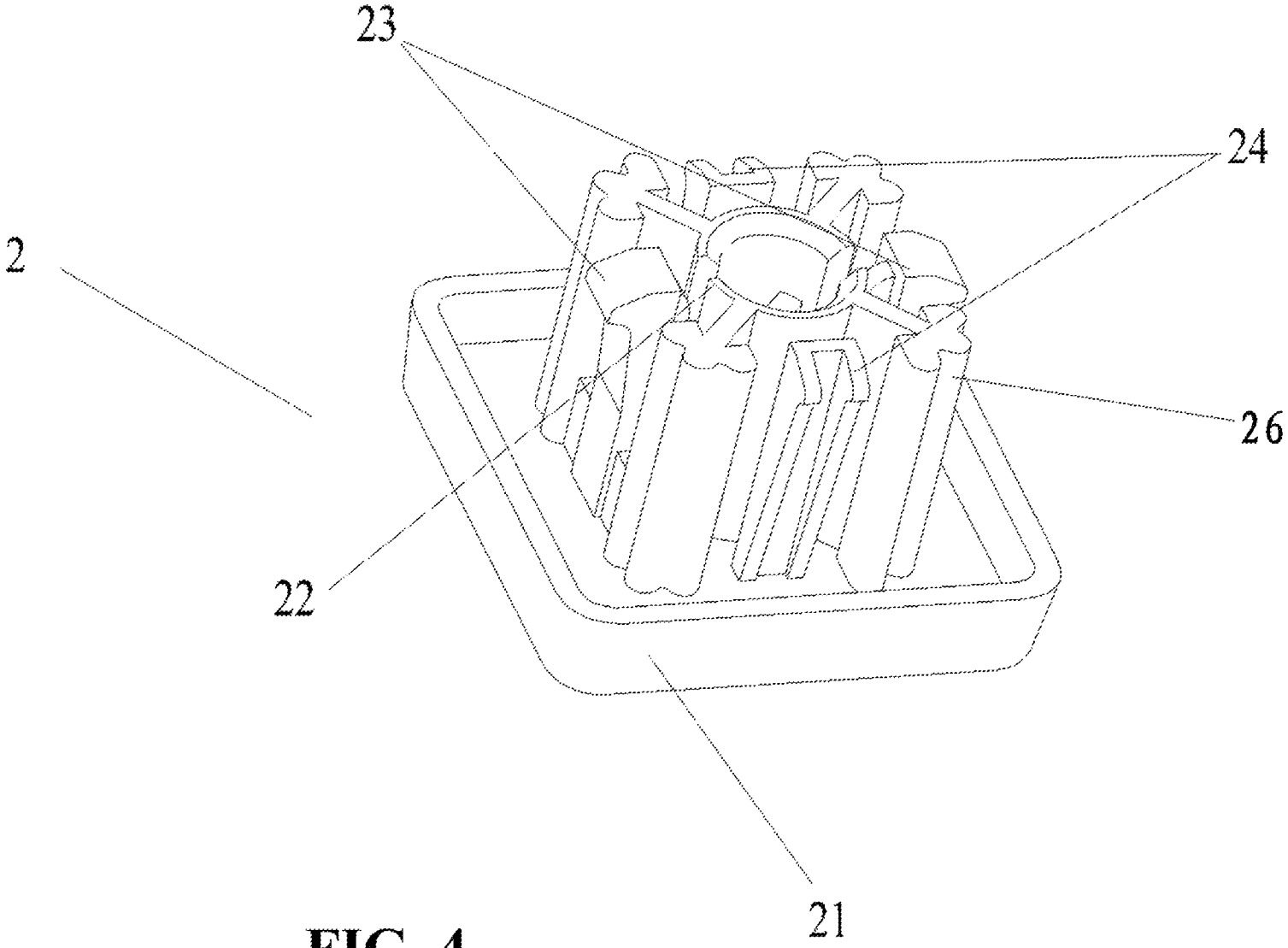
FIG. 4 shows a schematic structural diagram of a first key structure according to one embodiment of the present disclosure.
Figure 7:
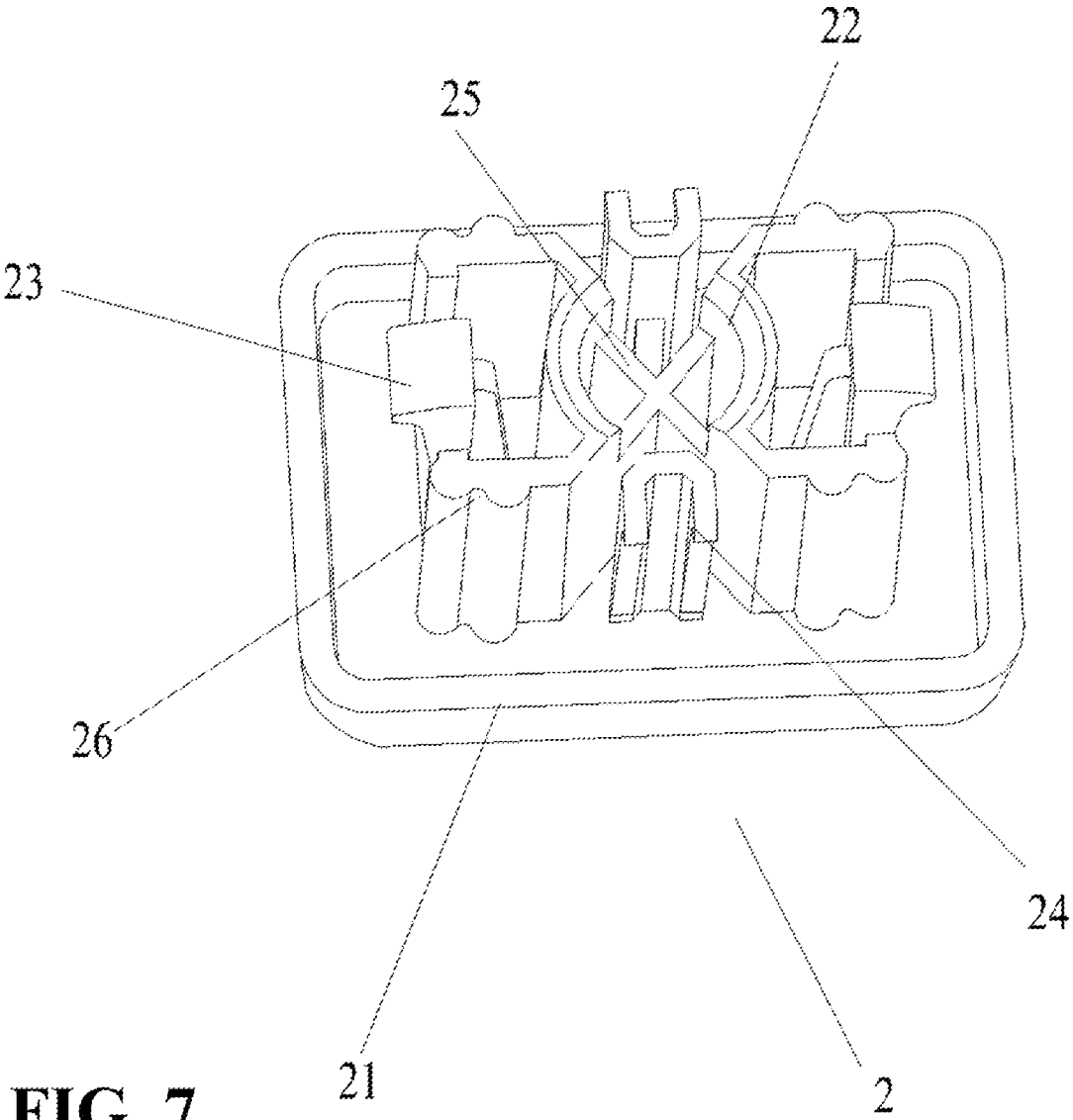
FIG. 7 shows a schematic structural diagram of a first key structure from another perspective according to one embodiment of the present disclosure.

A silent keyboard is disclosed as shown in FIG. 1 and FIG. 7. The silent keyboard comprises multiple first key structures 2 and a base frame 1 comprising multiple first receiving chambers 11. Each first receiving chamber 11 is provided with a first frame 111 formed on the inner walls of the first receiving chamber 11 and utilized for placing one of the multiple first key structures 2. Each first key structure 2 comprises a first key cap 21, four guiding pillars 26 formed on underside of the first key cap 21 and extending outward from the first key cap 21, a first pressing portion positioned on the underside of the first key cap 21; and a trigger portion 4 positioned on the underside of the first pressing portion. The first pressing portion is formed of two strengthening strip elements 25 intersected with each other. Two hooks 23 positioned in opposing sides are formed on the underside of the first key cap 21 and extend outward from the first key cap 21. Two silencing strip elements 24 positioned in opposing sides are formed on the underside of the first key cap 21 and extend outward from the first key cap 21. The two silencing strip elements 24 engage with the inner walls of the first frame 111. Two grooves 1111 are formed on the inner walls of the first frame 111. The two hooks 23 respectively engage with the two grooves 1111, while each of the two hooks 23 is arranged to operably slide along a corresponding groove 1111. The two silencing strip elements 24 engage with the inner walls of the first frame 111, so as to ensure the first key structure 2 can slide steadily within the first frame 111 and does not tilt while sliding. The above structure decreases the possibility of that the first key structure 2 collides with the first frame 111, thereby rendering the first key structure 2 can be manipulated more smoothly by the user, while reducing the resulting noise caused by the first key structure 2 when it is being manipulated, and thus it can offer a desirable silent usage experience to the user.

In this embodiment, in order to render the first key structure 2 can be easily positioned in the first receiving chamber 11, at least one guiding slot 1112 is formed on the inner walls of the first frame 111, and one of the four guiding pillars 26 is arranged to operably slide along a guiding slot 1112. Additionally, the presence of the guiding slot 1112 enables the four guiding pillar 26 to slide more steadily within the first frame 111 and does not tilt while sliding. Preferably, the first frame 111 comprises two guiding slots 1112, which are respectively positioned on opposing positions of the inner walls of the first frame 111, and are positioned in different locations on a same horizontal plane.

In this embodiment, the silent keyboard further comprises a second key structure 3 and a second receiving chamber 12 positioned in the base frame 1. The second key structure 3 comprises a second key cap 31, a second pressing portion positioned on the underside of the second key cap 31, and a trigger portion 4 positioned on the underside of the second pressing portion. A second frame 121 is formed in the second receiving chamber 12, while two grooves 1111 are formed on the inner walls of the second frame 121. The second pressing portion is formed of two strengthening strip elements 25 intersected with each other. Two hooks 23 positioned in opposing sides are formed on the underside of the second key cap 31 and extend outward from the second key cap 31. Two silencing strip elements 24 positioned in opposing sides are formed on the underside of the second key cap 31 and extend outward from the second key cap 31. The two silencing strip elements 24 on the second key cap 31 engage with the inner walls of the second frame 121. The two hooks 23 on the second key cap 31 respectively engage with the two grooves 1111 on the second frame 121, while each of the two hooks 23 is arranged to operably slide along a corresponding groove 1111. The size of the second key structure 3 is bigger than the size of the first key structure 2. After the second key structure 3 is pressed, it is unable to rapidly restore the second key structure 3 to an original position merely by relying on the elastic force of the trigger portion 4 made by the elastic rubber. Therefore, the second receiving chamber 12 is provided with an elastic supporting element 33 for restoring the second key cap 31 to the original position. The elastic force of the elastic supporting element 33 can rapidly restore the second key structure 3 to the original position. Specifically, two clamping elements 32 are positioned on the underside of the second key cap 31, and the two clamping elements 32 respectively engage with two ends of the elastic supporting element 33. The second key cap 31 comprises two pilot pillars 34 respectively positioned at two locations on the underside of the second key cap 31. Two pilot holes 35 are formed on the underside of the second receiving chamber 12, while the two pilot pillars 34 are respectively arranged to operably slide along the two pilot holes 35. When the second key cap 31 is pressed, the two pilot pillars 34 slide down along the two pilot holes 35, so as to render the second key structure 3 to move stably. In this time, the two ends of the elastic supporting element 33 are respectively pressed by the two clamping elements 32. When the force applied on the second key cap 31 is removed, the elastic restoring forces of the two ends of the elastic supporting element 33 then raise the two clamping elements 32 upward, so as to rapidly restore the second key structure 3 to the original position.

In this embodiment, each of the silencing strip elements 24 on the underside of the first key cap 21 gradually approaches a corresponding inner wall from a top side of the first key cap 21 to a bottom side of the first key cap 21, while each of the hooks 23 gradually approaches a corresponding inner wall from the top side of the first key cap 21 to the bottom side of the first key cap 21. As a result, each of the silencing strip elements 24 and each of the hooks 23 on the first key cap 21 would be closer to the inner walls, so that the first key cap 21 has less wobble when it is being pressed. Similarly, each of the silencing strip elements 24 on the underside of the second key cap 31 gradually approaches a corresponding inner wall from a top side of the second key cap 31 to a bottom side of the second key cap 31, while each of the hooks 23 gradually approaches a corresponding inner wall from the top side of the second key cap 31 to the bottom side of the second key cap 31. As a result, each of the silencing strip elements 24 and each of the hooks 23 on the second key cap 31 would be closer to the inner walls, so that the second key cap 31 has less wobble when it is being pressed.

In this embodiment, the compression stroke of the aforementioned trigger portion 4 of the first key structure 2 is 3 mm and the compression stroke of the aforementioned trigger portion 4 of the second key structure 3 is also 3 mm, but the compression stroke of a conventional trigger portion is merely 2.25 mm Increasing the compression stroke of the trigger portion 4 may provide a more comfortable use experience to the user of the silent keyboard.

Figure 5:
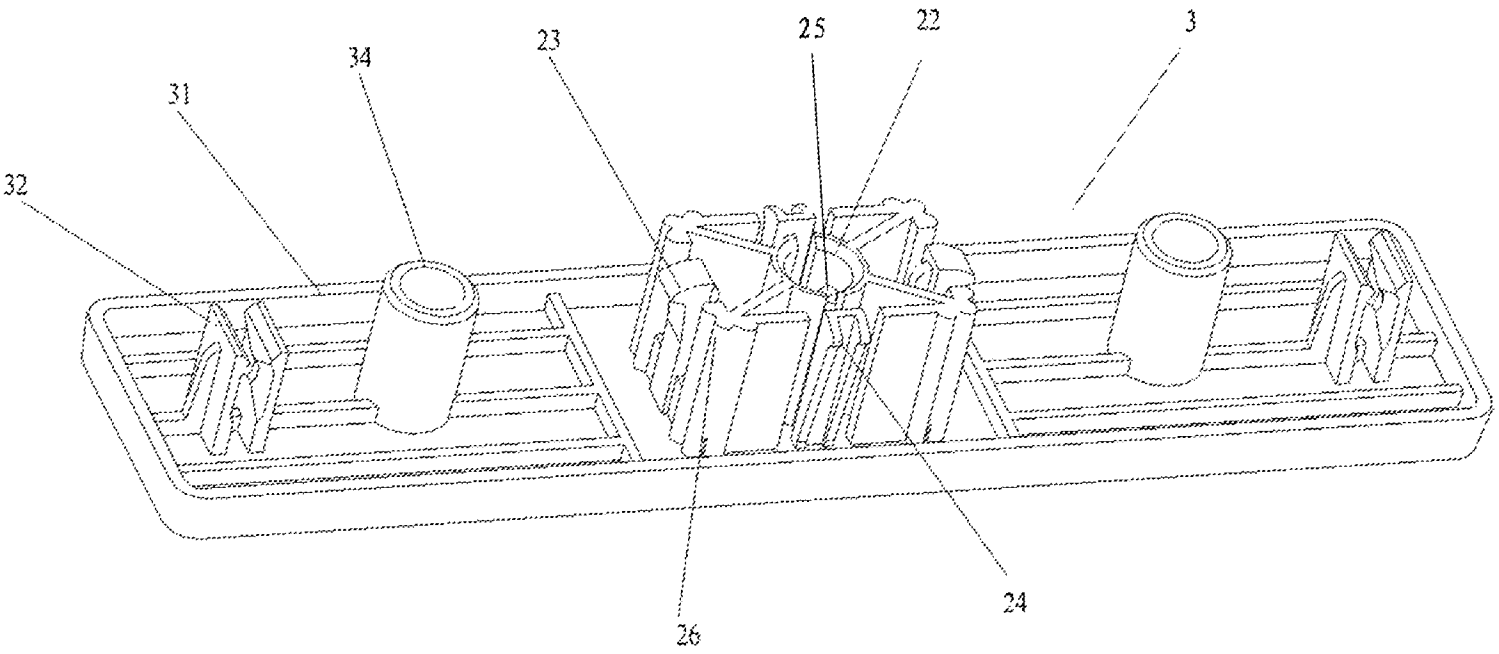
FIG. 5 shows a schematic structural diagram of a second key structure according to one embodiment of the present disclosure.
Figure 6:
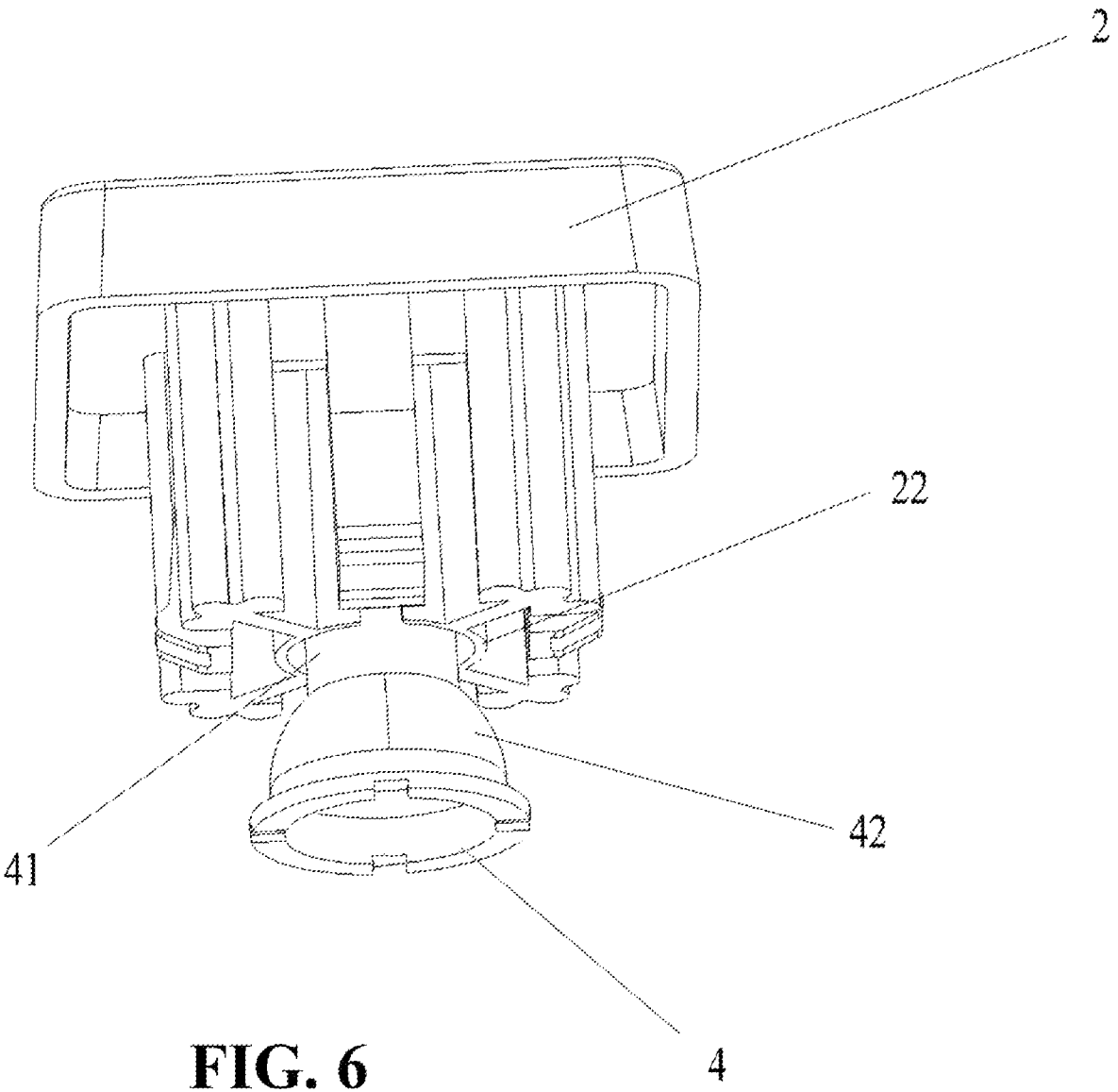
FIG. 6 shows a schematic structural diagram of a first key structure and a trigger portion according to one embodiment of the present disclosure.

In this embodiment, as shown in FIG. 5, FIG. 6 and FIG. 7, the trigger portion 4 of the first key structure 2 and the second key structure 3 comprises a neck portion 41 and a bowl-shaped supporting frame 42 connecting the neck portion 41. Additionally, an engaging element 22 is positioned on the underside of the first key cap 21 and extends toward the trigger portion 4 of the first key structure 2, wherein the engaging element 22 is positioned around the two strengthening strip elements 25 of the first key cap 21 and engages with the neck portion 41 of the trigger portion 4. Similarly, an engaging element 22 is positioned on the underside of the second key cap 31 and extends toward the trigger portion 4 of the second key structure 3, wherein the engaging element 22 is positioned around the two strengthening strip elements 25 of the second key cap 31 and engages with the neck portion 41 of the trigger portion 4. Even if the force is unequally applied on the first key cap 21 or the second key cap 31 when user pressing the first key cap 21 or the second key cap 31, the engaging element 22 still applies force uniformly to the neck portion 41 of the corresponding trigger portion 4, so as to avoid the neck portion 41 from deformed or wobbling, thereby increasing the usage convenience and the manipulation stability of the silent keyboard. Even if the user often applies unequally force to the first key cap 21 or the second key cap 31 for a long term, it would not easily result in plastic deformation of the neck portion 41, and thus the disclosed keyboard structure of the present disclosure has a greater durability.

In this embodiment, the silent keyboard further comprises a base plate 5 and a circuit board 6, wherein the circuit board 6 is positioned between the base plate 5 and the base frame 1. When the first key cap 21 or the second key cap 31 is pressed downward by the user, the first pressing portion 22 or the second pressing portion 32 would be moved downward, thereby applying a force to the trigger portion 4, so that the trigger portion 4 can be conducted with the circuit board 6.

The disclosed silent keyboard provides many advantages in comparison with the conventional keyboard. For example, the first pressing portion formed of the two strengthening strip elements intersected with each other increase the stability of the four guiding pillars. As described previously, two grooves are formed on the inner walls of the first frame; two hooks positioned in opposing side are formed on the underside of the first key cap and extend outward from the first key cap; and two silencing strip elements positioned in opposing side are formed on the underside of the first key cap and extend outward from the first key cap. Since the two hooks respectively engage with the two grooves, and each of the two hooks can slide along the corresponding groove, while the two silencing strip elements engage with the inner walls of the first frame, the first key structure can thus slide steadily within the first frame and does not tilt while sliding, thereby reducing the possibility of that the first key structure collides with the frame. As a result, the disclosed structure not only ensures that the first key structure can be manipulated more smoothly by the user, but also results in less noise when the first key structure when is manipulated by the user. Accordingly, the keyboard structure disclosed above is quieter than the conventional keyboard when manipulated by the user.

Certain terms are used throughout the description and the claims to refer to particular components. One skilled in the art appreciates that a component may be referred to as different names. This disclosure does not intend to distinguish between components that differ in name but not in function. In the description and in the claims, the term "comprise" is used in an open-ended fashion, and thus should be interpreted to mean "include, but not limited to." The term "couple" is intended to compass any indirect or direct connection. Accordingly, if this disclosure mentioned that a first device is coupled with a second device, it means that the first device may be directly or indirectly connected to the second device through electrical connections, wireless communications, optical communications, or other signal connections with/without other intermediate devices or connection means.

The term "and/or" may comprise any and all combinations of one or more of the associated listed items. In addition, the singular forms "a," "an," and "the" herein are intended to comprise the plural forms as well, unless the context clearly indicates otherwise.

Throughout the description and claims, the term "element" contains the concept of component, layer, or region.

In the drawings, the size and relative sizes of some elements may be exaggerated or simplified for clarity. Accordingly, unless the context clearly specifies, the shape, size, relative size, and relative position of each element in the drawings are illustrated merely for clarity, and not intended to be used to restrict the claim scope.

For the purpose of explanatory convenience in the specification, spatially relative terms, such as "on," "above," "below," "beneath," "higher," "lower," "upward," "downward," and the like, may be used herein to describe the function of a particular element or to describe the relationship of one element to another element(s) as illustrated in the drawings. It will be understood that the spatially relative terms are intended to encompass different orientations of the element in use, in operations, or in assembly in addition to the orientation depicted in the drawings. For example, if the element in the drawings is turned over, elements described as "on" or "above" other elements would then be oriented "under" or "beneath" the other elements. Thus, the exemplary term "beneath" can encompass both an orientation of above and beneath.

Throughout the description and claims, it will be understood that when a component is referred to as being "positioned on," "positioned above," "connected to," "engaged with," or "coupled with" another component, it can be directly on, directly connected to, or directly engaged with the other component, or intervening component may be present. In contrast, when a component is referred to as being "directly on," "directly connected to," or "directly engaged with" another component, there are no intervening components present.

Other embodiments of the invention will be apparent to those skilled in the art from consideration of the specification and practice of the invention disclosed herein. It is intended that the specification and examples be considered as exemplary only, with a true scope and spirit of the invention indicated by the following claims.

What is claimed is:

1. A silent keyboard, comprising:

a base frame (1) comprising multiple first receiving chambers (11); and multiple first key structures (2);

wherein each first receiving chamber (11) of the multiple first receiving chambers (11) is provided with a first frame (111) formed on inner walls of the first receiving chamber (11) and utilized for placing one of the multiple first key structures (2), while two grooves (1111) are formed on inner walls of the first frame (111);

wherein each first key structure (2) of the multiple first key structures (2) comprises:

a first key cap (21);

four guiding pillars (26) formed on an underside of the first key cap (21) and extending outward from the first key cap (21);

a first pressing portion positioned on the underside of the first key cap (21); and a trigger portion (4) positioned on an underside of the first pressing portion;

wherein the first pressing portion is formed of two strengthening strip elements (25) intersected with each other;

two hooks (23) positioned in opposing sides are formed on the underside of the first key cap (21) and extend outward from the first key cap (21);

two silencing strip elements (24) positioned in opposing sides are formed on the underside of the first key cap (21) and extend outward from the first key cap (21);

the two silencing strip elements (24) engage with the inner walls of the first frame (111), while the two hooks (23) respectively engage with the two grooves (1111) of the first frame (111); and each of the two hooks (23) of the first key cap (21) is arranged to operably slide along a corresponding groove (1111) of the first frame (111).

2. The silent keyboard of claim 1, wherein at least one guiding slot (1112) is formed on the inner walls of the first frame (111), and one of the four guiding pillars (26) is arranged to operably slide along the at least one guiding slot (1112).

3. The silent keyboard of claim 2, wherein the first frame (111) comprises two guiding slots (1112), and the two guiding slots (1112) are respectively positioned on opposing positions of the inner walls of the first frame (111).

4. The silent keyboard of claim 3, wherein the two guiding slots (1112) are positioned in different locations on a same horizontal plane.

5. The silent keyboard of claim 1, further comprising:

a second key structure (3); and a second receiving chamber (12) positioned in the base frame (1);

wherein the second key structure (3) comprises:

a second key cap (31);

a second pressing portion positioned on an underside of the second key cap (31);

a trigger portion (4) positioned on an underside of the second pressing portion; and an elastic supporting element (33) utilized for restoring the second key cap (31) to an original position;

wherein a second frame (121) is formed in the second receiving chamber (12), while two grooves (1111) are formed on inner walls of the second frame (121);

wherein the second pressing portion is formed of two strengthening strip elements (25) intersected with each other;

two hooks (23) positioned in opposing sides are formed on the underside of the second key cap (31) and extend outward from the second key cap (31);

two silencing strip elements (24) positioned in opposing sides are formed on the underside of the second key cap (31) and extend outward from the second key cap (31);

the two silencing strip elements (24) engage with the inner walls of the second frame (121), while the two hooks (23) respectively engage with the two grooves (1111) of the second frame (121); and each of the two hooks (23) of the second key cap (31) is arranged to operably slide along a corresponding groove (1111) of the second frame (121).

6. The silent keyboard of claim 5, wherein two clamping elements (32) are positioned on the underside of the second key cap (31), and respectively engage with two ends of the elastic supporting element (33).

7. The silent keyboard of claim 5, wherein the second key cap (31) comprises two pilot pillars (34) respectively positioned at two locations on the underside of the second key cap (31), and two pilot holes (35) are formed on underside of the second receiving chamber (12), wherein the two pilot pillars (34) are respectively arranged to operably slide along the two pilot holes (35).

8. The silent keyboard of claim 5, wherein the trigger portion (4) of the first key structure (2) comprises a neck portion (41) and a bowl-shaped supporting frame (42) connecting to the neck portion (41), the first key structure (2) comprises an engaging element (22) positioned around the two strengthening strip elements (25) of the first key structure (2) and extending toward the trigger portion (4) of the first key structure (2), and the engaging element (22) of the first key structure (2) engages with the neck portion (41) of the trigger portion (4) of the first key structure (2);

wherein the trigger portion (4) of the second key structure (3) comprises a neck portion (41) and a bowl-shaped supporting frame (42) connecting to the neck portion (41) of the trigger portion (4) of the second key structure (3); and the second key structure (3) comprises an engaging element (22) positioned around the two strengthening strip elements (25) of the second key structure (3) and extending toward the trigger portion (4) of the second key structure (3), and the engaging element (22) of the second key structure (3) engages with the neck portion (41) of the trigger portion (4) of the second key structure (3).

9. The silent keyboard of claim 1, wherein the trigger portion (4) of the first key structure (2) comprises a neck portion (41) and a bowl-shaped supporting frame (42) connecting to the neck portion (41), the first key structure (2) comprises an engaging element (22) positioned around the two strengthening strip elements (25) and extending toward the trigger portion (4), and the engaging element (22) engages with the neck portion (41) of the trigger portion (4) of the first key structure (2).

10. The silent keyboard of claim 1, wherein each of the silencing strip elements (24) on the underside of the first key cap (21) gradually approaches a corresponding inner wall from a top side of the first key cap (21) to a bottom side of the first key cap (21), while each of the hooks (23) on the underside of the first key cap (21) gradually approaches a corresponding inner wall from the top side of the first key cap (21) to the bottom side of the first key cap (21).

11. The silent keyboard of claim 1, wherein the trigger portion (4) in the first key structure (2) has a compression stroke of 3 mm.

* * * * *